United States Patent [19]

Beasock et al.

[11] Patent Number: 4,865,309

[45] Date of Patent: Sep. 12, 1989

[54] METHOD AND APPARATUS FOR ALIGNING WORKPIECES OF VARIABLE LENGTHS

[75] Inventors: Robert J. Beasock, Rome; Clayton C. Cooper, III, Waterford, both of N.Y.

[73] Assignee: Cluett, Peabody & Co., Inc., New York, N.Y.

[21] Appl. No.: 228,380

[22] Filed: Aug. 4, 1988

[51] Int. Cl.[4] ..... B65H 7/14

[52] U.S. Cl. ..... 271/227; 271/176; 271/182; 271/259; 112/121.11

[58] Field of Search ..... 271/227, 228, 259, 261, 271/176, 199, 9, 182; 112/121.11, 121.12, 121.15, 275, 277

[56] References Cited

U.S. PATENT DOCUMENTS

| | | | |
|---|---|---|---|
| 3,741,357 | 6/1973 | Krysink | 271/227 X |
| 4,176,832 | 12/1979 | Hughes | 271/227 X |
| 4,682,554 | 7/1987 | Goto | 112/121.11 X |

*Primary Examiner*—Richard A. Schacher
*Attorney, Agent, or Firm*—Schweitzer & Cornman

[57] ABSTRACT

Method and apparatus for feeding one or more fabric sections whose precise length is variable. The fabric sections are transferred to a delivery position, in which they are precisely centered, enabling uniform end margins to be realized notwithstanding length variability in the workpiece. As a workpiece is advanced on the shutter, its leading and trailing edges are sensed optically. A precise length determination is made by accumulating increments of lengths with a digital encoder. The leading edge of the workpiece is sensed at a delivery station, and the accumulated increment count is decremented at twice the rate of incrementation. When the accumulated count is reduced to zero, the workpiece is exactly centered in relation to a known position, and is engaged and held in that position while the shutter plate completes its transfer motion.

17 Claims, 2 Drawing Sheets

METHOD AND APPARATUS FOR ALIGNING WORKPIECES OF VARIABLE LENGTHS

BACKGROUND AND SUMMARY OF THE INVENTION

The present invention is directed to method and apparatus for effecting precise alignment of workpieces of variable lengths, to enable a plurality of workpieces to be assembled in an automatic manner, with a high degree of precision. In the manufacture of garments, such as shirts, it is conventional practice to assemble and join multi-ply assemblies of fabric workpieces. In the manufacture of collars and cuffs, for example, one or more plies of outer fabric material are assembled with a ply of liner material, and the multi-part subassembly ultimately is incorporated into the final garment. In the production of the subassemblies, an important first step is the positioning of one workpiece upon the other in proper alignment, to enable subsequent folding and sewing operations to be carried out properly. Insofar as possible, the various necessary operations are carried out entirely by automatic equipment, so that operator intervention is limited to the greatest possible extent.

In the assembly of a liner ply to an outer cuff or collar ply, for example, the liner ply typically is somewhat smaller in dimensions than the outer ply. Accordingly, it is generally desirable to center the liner ply on the outer ply, at least in the lengthwise direction, providing even margins at both ends. The automation of this process, while conceptually simple, has proven to be difficult in practice, because the various parts, while nominally standardized in length, are in fact somewhat variable in length. This variability results from the fact that the parts are cut with automatic knifes from very thick stacks of fabric such that, with even minor misalignments, the dimensions of parts from the top of the stack may vary somewhat from those of the bottom of the stack, for example.

In accordance with the present invention, a method and apparatus is provided for longitudinally feeding and precisely centering lengthwise one or more fabric workpieces, so that the workpiece or workpieces can be delivered to predetermined centered position, with a high degree of repetitive accuracy, notwithstanding unknown variations in the length of the individual workpieces.

In a particularly advantageous version of the invention, a plurality of workpieces, destined to be assembled one with the other, are transported lengthwise from their respective supply stacks to a precise delivery position, where each workpiece is precisely centered along a predetermined delivery axis. This allows the individual pieces to be picked up and stacked one upon the other, with highly uniform end margins, for subsequent folding, sewing and other processing.

In a most advantageous form of the invention, transfer of the fabric workpieces from a loading position to a delivery position is carried out through a digitally encoded transfer control device, which issues a digitized signal for each predetermined increment of movement of the workpiece. As the workpiece is advanced, its leading and trailing edges are sensed by optical sensing devices. In the interval between the sensing of the leading edge and the sensing of the trailing edge, each small increment of movement of the transfer device results in the issuance of a digitized signal, and the succession of signals is accumulated as a data count in a memory device. Near the delivery location, a second optical sensor detects the arrival of the leading edge of the workpiece and, with each continued increment of transfer motion, causes a decrementing of the accumulated data count of the digitized signals, at twice the rate of accumulation. When the accumulated data count has been reduced to zero, the workpiece is known to be precisely centered along a predetermined delivery alignment axis. Instantly, the trailing edge of the workpiece is gripped and restrained, while the transfer device is permitted to complete its full cycle of movement in the delivery direction.

Significant to the procedure of the invention is the initial loading of the workpieces onto the transfer shutter in a position which is reliably forward of the final location of the workpiece on the shutter, when the shutter has reached the limit of its delivery motion and the workpiece is precisely centered along the delivery alignment axis. This can readily be accomplished without difficulty by providing for the initial loading of the workpiece onto the delivery shutter sufficiently far forward to accommodate the maximum deviation from nominal dimensions (i.e., the longest acceptable workpiece dimension). Under all circumstances, then, the workpiece can be precisely centered longitudinally by restraining the trailing edge portion of the workpiece, at the appropriate moment, while the delivery shutter continues to advance to the end of its stroke.

For a more complete understanding of the above and other features of the invention, reference should be made to the following detailed description of a preferred embodiment of the invention, and to the accompanying drawings.

DESCRIPTION OF PREFERRED EMBODIMENT OF THE INVENTION

Figure 1:
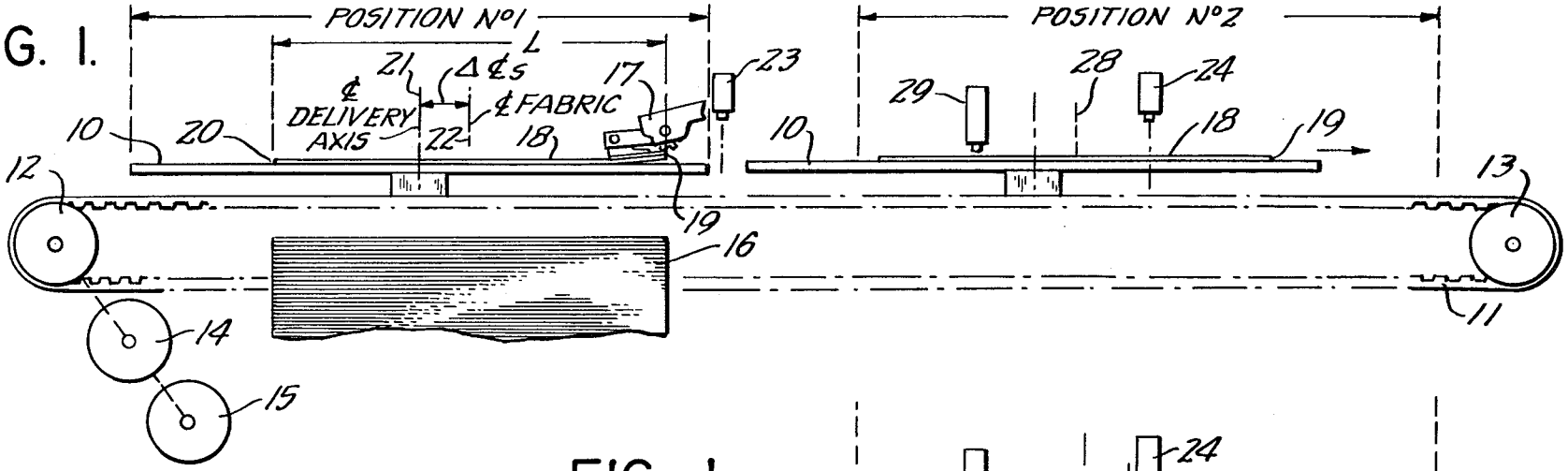
FIG. 1 is a simplified schematic illustration of a system according to the invention for transferring fabric workpieces from a loading position to a delivery position, with the ability to deposit the workpiece in a precisely longitudinally centered position with respect to a predetermined delivery alignment axis.

Referring now to the drawing, and initially to FIG. 1 thereof, there is schematically illustrated a system for receiving fabric workpieces from individual supplies thereof and transferring them to a delivery location for assembly and processing—typically involving sewing and/or folding operations. In the illustrated arrangement a single delivery shutter 10, in the form of a flat plate, is attached to a positive drive belt 11, trained about pulleys 12, 13. One of the pulleys, for example the pulley 12, is driven by a reversible electric or other known driving device motor 14, which is also associated with a rotary digital encoder 15. The encoder 15 enables rotary movement of the pulley 12, and therefore linear movement of the shutter 10, to be precisely monitored, as will be further described.

Although some of the principles of the invention are applicable to the transfer of a single workpiece, a more typical application of the principles of the invention is in the simultaneous transfer of two or more workpieces from a predetermined loading position to a predetermined delivery position. In the latter, the multiple workpieces are assembled and processed. The invention will accordingly be described with reference to a system for the simultaneous transfer of two workpieces, typically a liner ply and an outer ply, a for a shirt cuff or collar, for example.

In FIG. 1, the shutter 10 in the left hand position, labeled Position No. 1, is in the "loading" position, for receiving one of each of the workpieces to be transferred. To advantage, the workpiece supplies are arranged in side-by-side stacks, one for each type of workpiece, of which one such stack 16 is illustrated in FIG. 1. Each such stack is provided with a separate pick up device 17 arranged, when the shutter 10 is displaced away from the loading position during a delivery operation, to engage the upper surface of the stack 16 and lift therefrom a single ply 18 of fabric.

To special advantage, the supply and pick up arrangement may be in accordance with the teachings of the Kenneth O. Morton U.S. Pat. No. Re. 30,084, assigned to Cluett, Peabody & Co., Inc., the disclosure of which is hereby incorporated by reference. As described more fully therein, the picker device 17 is arranged to engage and lift one end edge of the ply 18 from its supply stack 16. The picker then lifts sufficiently to hold that edge above the plane of the shutter 10 as it returns from its delivery position (designated Position No. 2 in FIG. 1), the end of the shutter engages the partially draped, lifted ply, fully separates it from the supply stack 16 and supports the ply in the manner shown in FIG. 1 of the drawing, position No. 1. When the shutter 10 has reached the limit of its return movement, and is stopped in the "load" position, the picker head 17 releases its grip from the fabric and retracts upwardly, leaving the fabric ply 18 supported exclusively by the upper surface of the shutter plate 10.

In accordance with the invention, the "loading" limit position of the shutter 10 (i.e., Position No. 1 of FIG. 1) is so related to the position of the supply stacks 16 and picker heads 17 that, when the fabric plies 18 are deposited on the shutter plate 10 and released by their picker heads, the centers of the fabric plies, that is the location midway between their leading and trailing edges 19, 20, respectively, are located well forward (toward the right in FIG. 1) of a predetermined delivery alignment axis 21, which may but need not coincide with the physical center line of the shutter itself.

In FIG. 1 of the drawing, the legend $\Delta$ s designates the forward offset of the center line of a fabric ply from the predetermined delivery alignment axis. This forward offset is, by design, sufficient that the physical center line 22 of the deposited fabric workpiece is under all conditions forward of the delivery alignment axis 21. In this respect, it will be understood that, with the leading edge 19 of the fabric being deposited in a reasonably uniform position on the shutter 10, the center line of the fabric and the trailing edge 20 thereof will vary in location as a function of the length L of the fabric, which is specifically unknown and is a variable within controlled limits.

After each of the plies has been deposited on the transfer shutter 10, the driving device motor 14 may be energized to commence the movement of the shutter toward the delivery position (position No. 2 in FIG. 1). During such movements, the digital encoder 15 generates an output pulse for each increment of linear movement of the shutter. In one advantageous version of the invention, an output pulse is generated for each 1/64th inch of such linear movement.

Figure 3:
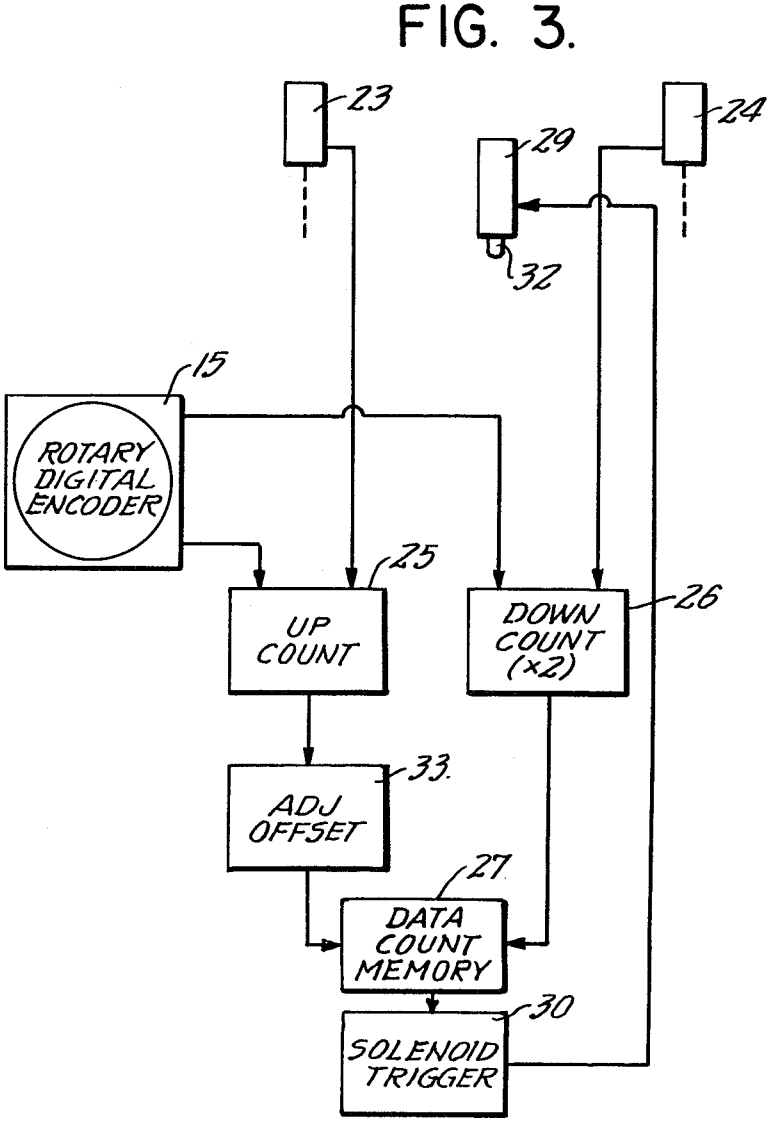
FIG. 3 is a simplified schematic illustration of a control circuit appropriately used with the method and apparatus of the invention.
Figure 2A:
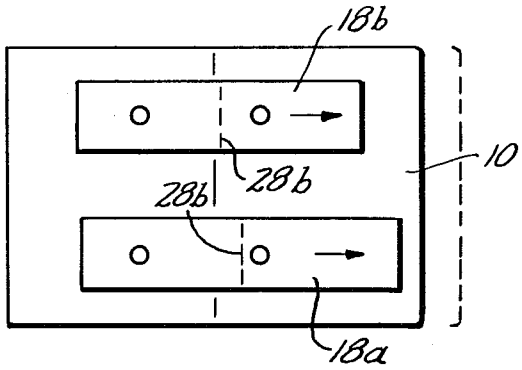
FIGS. 2*a*–2*c* are partial top plan views, illustrating the apparatus in positions corresponding generally to those of FIGS. 1*a*–1*c* respectively.
Figure 2B:
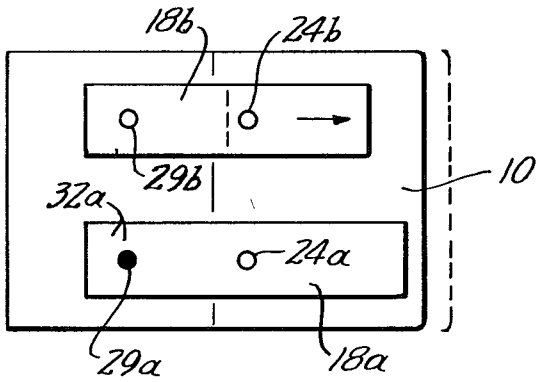
Figure 2C:
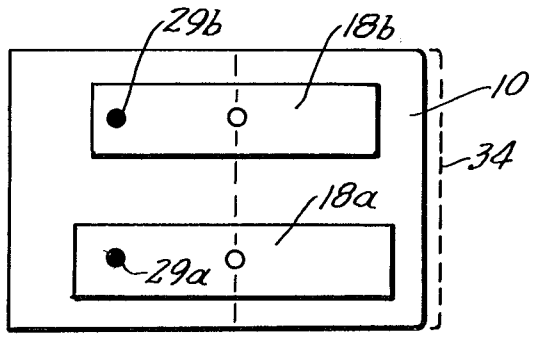

Pursuant to the invention, a first optical sensor 23 is positioned at a fixed location in front of the leading edges 19 of the respective deposited fabric plies 18. It will be understood, in this respect, that a separate and independent control system is provided for each deposited fabric ply, such that each ply is centered according to its own individual dimensions, as will become apparent. For purposes of simplicity, only a single control system is illustrated in FIGS. **1–1*c* and in FIG. 3, while FIGS. 2*a*–2*c* illustrate certain elements of a second control system for a second fabric ply. With reference to the illustration of FIG. 1, when the leading edge 19 of the fabric ply passes under the optical sensor 23, the sensor detects a change from the relatively reflective upper surface of the shutter 10 to the relatively nonreflective surface of the fabric. This triggers a control circuit (shown schematically in FIG. 3) of a microprocessor to activate an "up count" register 25 in FIG. 3, effectively causing the output pulses generated by the digital encoder 15 to be accumulated in a data count memory 27. In due course, when the trailing edge 20 of the fabric ply passes under the optical sensor 23, it senses the change in reflectivity and deactivates the Up count register and terminates the accumulation of data counts in the memory. As will be appreciated, the total number of increments represented by the up count reflects precisely the actual length of the individual ply 18**.

As the movement of the shutter 10 toward the delivery position continues, the leading edge 19 of the fabric ply in due course passes under a second optical sensor 24. This triggers in the circuit of FIG. 3 the activation of a "down count" register 26 for the motion increment pulses generated by the encoder 15. In one advantageous form of the invention, the data counts are managed in a simple microprocessor, and the down count increments are effectively multiplied by two. For purposes of explanation, and not necessarily as representing the technical operation of the microprocessor, the up count register 25 serves to increment the data count memory 27, while the down count register 26 decrements the data count memory, but at a rate of two data counts per increment of motion. When the data count memory has been decremented to zero, the workpiece 18 will have been advanced exactly one half of its length, following sensing of the leading edge 19 by the second optical sensor 24. The exact center line of the workpiece is thus located.

As will be understood, the decrementing of the data count may commence prior to completion of the incrementation, as long as the incrementation is complete before the data count becomes zero. In a simple circuit arrangement this is assured by spacing the second optical sensor 24 from the first a distance of more than half the maximum length of the fabric workpieces.

Figure 1A:
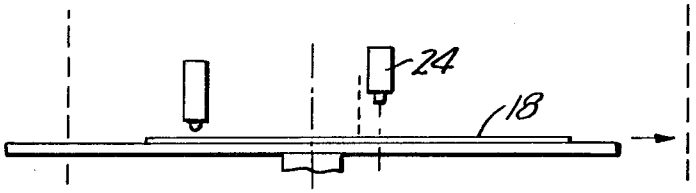
FIGS. 1*a*, 1*b*, and 1*c* are partial side elevational illustrations of the apparatus of FIG. 1, showing the delivery shutter and workpiece approaching the final delivery position, with the workpiece precisely centered on the delivery alignment axis.
Figure 1B:
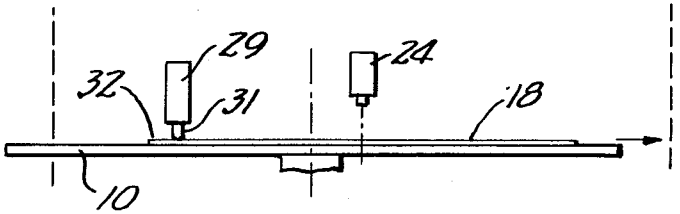
Figure 1C:
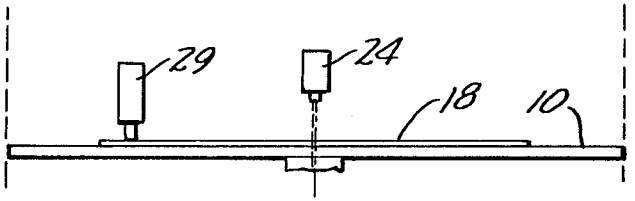

In an advantageous system according to the invention, the design of the shutter transfer mechanism is such that, when the center line of the fabric workpiece becomes precisely aligned with the predetermined delivery position, the shutter 10 has not yet travelled to its final position in the delivery direction. Accordingly, means is provided for engaging and restraining the workpiece in proper delivery alignment, while the shutter completes its movement. This sequence is reflected in FIGS. 1–1c, for example.

In the illustration of FIG. 1, in position No. 2, the shutter 10 has advanced the workpiece 18 to a point where the exact center line 28 of the workpiece is approaching the delivery location, which, in this instance, is coincident with the axis of the second sensor 24. When the center line of the workpiece is coincident with the delivery location (see FIG. 1*b*) a solenoid device 29 is actuated by a solenoid trigger 30 (FIG. 3) responding to the zeroing of the data count. A solenoid plunger 31 is projected downwardly into engagement with the a trailing edge portion 32 of the workpiece, to engage and restrain the trailing edge of the workpiece as the shutter 10 continues to move and slide underneath the restrained fabric. The workpiece 18 will remain in its restrained condition until the shutter 10 reaches its final delivery position, shown in FIG. 1*c*.

Bearing in mind that the operation of the solenoid 29 is not instantaneous, and in order to accommodate additional controllable individual variation in the precise final positioning of each of several side-by-side workpieces 18, the system of the invention includes a controllably adjustable offset count register 33 for each ply. This enables a precisely adjustable offset count to be added to or subtracted from the data count memory 27, as may be desired. Thus, to accommodate any delay resulting from inertia of the solenoid device 29, the adjustable offset register 33 can be set to effectively subtract an adjustable number of counts from the up count supply to the data count memory. The data count will thus be caused to zero out slightly in advance of the center line of the fabric reaching the desired delivery location so that, accounting for the inertia delay of the solenoid, the fabric will end up in the precise desired alignment. Additionally, the offset adjustment 33 allows some "fine tuning" of the desired final position of each workpiece, enabling a high degree of precision in the control of the final alignment of a plurality of workpieces fed simultaneous. Of course, the offset adjustment is a set-up adjustment and is normally not altered during a production run.

In the illustration of FIGS. 2*a*–2*c*, the shutter 10 is shown with two workpieces 18*a*, 18*b*, respectively, of different lengths, each being positioned on the shutter with its center line 28*a*, 28*b* located differently on the shutter. FIG. 2*a* corresponds in general to the positions illustrated in FIG. 1*a*, and shows the workpiece 18*a* approaching its desired delivery position. In FIG. 2*b*, the fabric workpiece 18*a* has reached its desired delivery position, and the solenoid 29*a* has been actuated to engage and restrain the trailing end portion 32*a* of the workpiece. Meanwhile, the shutter 10 continues its movement toward its final delivery position, continuing to convey the second workpiece 18*b*. In FIG. 2*c*, the second workpiece 18*b* has reached its final delivery position, as determined by the zeroing out of the data count memory associated with the second workpiece, and the second restraining solenoid 29*b* has been actuated. In the illustration of FIG. 2*c*, at the moment of actuation of the second solenoid 29*b*, the shutter 10 is still continuing its movement toward the limit of its delivery motion, indicated by the broken line 34 in FIG. 2*c*.

As reflected in FIG. 2*c*, at the end of the delivery operation, the two fabric workpieces 18*a*, 18*b*, even though their specific lengths are unknown, are precisely centered, one relative to the other, with equal end margins of the larger piece 18*a* projecting beyond the ends of the smaller piece 18*b*. At this juncture, the fabric pieces can be picked up and assembled by automatic means, for subsequent processing. For this purpose, a pick up device such as illustrated in the Crawford U.S. Pat. No. 4,214,741, assigned to Cluett, Peabody & Co., Inc., may be employed to advantage. The disclosure of that patent is incorporated herein by reference.

As will be understood, lateral alignment of the workpieces 18 is to carried out, in addition to the longitudinal centering thereof according to the invention. Facilities for lateral alignment of the workpieces at the loading position are conventional and well known to those skilled in the art, and thus will not be described herein.

The method and apparatus of the invention provide a uniquely simplified yet wholly reliable system for effecting precision longitudinal alignment of fabric workpieces, which are fed from a supply and the individual lengths of which are not accurately known. According to the invention, the exact length of the workpiece is effectively measured by accumulation of pulses from a digital encoder, during the interval when the workpiece passes under an optical sensor. The accumulated data count is effectively compared with a second data count commenced as the leading edge of the workpiece approaches the final delivery position. In effect, the original data count is compared with the second data count, and control functions are initiated when the second data count indicates that the workpiece has travelled a distance corresponding to one half of that reflected by the first data count. In a simplified system, a common data count memory is incremented by the first count and decremented by a factor of two by the second count, and restraint of the workpiece is initiated when the count is decremented to zero.

By initially positioning all of a plurality of workpieces on the transfer shutter such that all of the workpieces necessarily arrive at a precisely aligned delivery position before the limit of travel of the shutter has been reached, it becomes possible to individually engage and restrain each of several fabric workpieces carried by a common shutter, as each workpiece comes into alignment with a common delivery axis. The system of the invention thus accommodates randomness not only in the individual length of the workpieces, but in the initial positioning of the workpieces on the transfer shutter, so long as each workpiece is sufficiently far forward on the shutter as to assure its arriving at the desired delivery location before the limit of shutter movement has been reached.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. Apparatus for centering fabric workpieces of variable length on a support, which comprises (a) a controllably movable shutter plate, (b) drive means for moving said shutter plate between a loading position and a delivery limit position, (c) a supply of workpieces positioned adjacent said loading position, (d) transfer means associated with said workpiece supply for transferring individual workpieces from said supply to said shutter plate, when said shutter plate is in said loading position, (e) said transfer means being adapted to deposit said workpieces on said shutter with said workpiece offset from the desired delivery location in a direction toward said delivery limit position, (f) first sensing means for sensing the leading and trailing edges of said workpiece during travel of said shutter from said loading position to said delivery limit position, (g) said drive means being operative to move said shutter through a distance at least as great as the length of the longest workpiece after sensing of said leading edge, (h) means for measuring incremental lengths of movement of said shutter during travel thereof toward said delivery limit position, including means effective to accumulate increments of length measured after sensing of said leading edge and prior to sensing of said trailing edge, (i) second sensing means positioned in the path of travel of said workpiece toward said delivery limit position and spaced from said first sensing means by an amount corresponding to at least one-half the length of the longest workpiece, (j) means for accumulating further measured increments of length subsequent to sensing by said second sensing means of the leading edge of said workpiece and effectively comparing said accumulated further increments with said accumulated first mentioned increments, (k) means operative in response to a predetermined comparison of said accumulated first mentioned and further increments to engage and restrain said workpiece in a predetermined workpiece delivery location while said shutter continues to move to its delivery limit position.

2. Apparatus according to claim 1, further characterized by (a) said means for effectively comparing said accumulated further increments with said accumulated first mentioned increments comprising sensing when said accumulated further increments comprise substantially one half of the accumulated first mentioned increments, whereby said accumulated first mentioned increments reflect accurately the actual length of said workpiece and the accumulated further increments represent substantially one half of the actual length of said workpiece.

3. Apparatus according to claim 2, further including (a) circuit means for decrementing said accumulated first mentioned increments by twice the value of the accumulating further increments, (b) said means to engage and restrain said workpiece being operative upon said accumulated first mentioned increments being decremented substantially to zero to fix the position of said workpiece while said shutter continues travel to its delivery limit position.

4. Apparatus according to claim 2, further including means for biasing one of said accumulating increment values for effecting fine adjustment of the final delivery location of said workpiece.

5. Apparatus according to claim 1, further characterized by (a) said shutter accommodating first and second workpieces in side-by-side relation, (b) said first and second workpieces being of different length and each being of unknown exact length, (c) there being independent and parallel sets of transfer means, first and second sensors, workpiece engaging and restraining means and accumulating and comparing circuitry for each of said workpieces, whereby as said shutter travels to its delivery limit position, each of said workpieces is separately engaged and restrained on said shutter and held in a predetermined delivery location centered with respect to its own actual length, enabling said workpieces to be assembled in a predetermined, properly centered orientation, one with respect to the other.

6. Apparatus for centering fabric workpieces of variable length, which comprises (a) a plurality of supply stacks of fabric workpieces positioned in side-by-side relation, (b) means for engaging and lifting the top ply of each stack by its leading edge, (c) a transfer shutter movable underneath said lifted plies whereby a ply of each stack is supported on said shutter when said shutter is moved to a loading position, (d) means for effecting transfer movement of said shutter to a delivery position, (e) first means for sensing the passage of the leading and trailing ends of each ply, individually, during said transfer movement, (f) means for generating a control signal for each increment of transfer movement of said shutter, (g) first control means associated with each ply for accumulating the incremental signals of movement between the sensing of the passage of the leading and trailing edges of such ply, whereby the accumulated signals reflect accurately the length of the individual ply, (h) second means, spaced forwardly of the first, for sensing the passage of the leading edges of individual plies as they are transferred toward a delivery position by said shutter, (i) second control means for effectively accumulating incremental signals of movement of a ply following sensing of its leading edge by said second sensing means, (j) means for effectively comparing, for each ply, the first and second accumulations of incremental signals, and (k) means for engaging and restraining each ply, individually and independently, when the second accumulation of incremental signals reflects passage of one half the workpiece length reflected by the first accumulation of signals, whereby said plies are individually positioned with their respective centers located in predetermined known positions.

7. Apparatus according to claim 6, further characterized by (a) said second sensing means being spaced from said first sensing means by a distance not less than one-half the maximum acceptable length of a workpiece to be transferred.

8. Apparatus according to claim 6, further characterized by (a) the individual side-by-side plies being of different length, (b) each of said plies, in the delivery position, having its center aligned on a predetermined delivery alignment axis, whereby one of said plies may be superposed upon the other with substantially equal end edge margins of the longer ply projecting from each end of the assembly of plies.

9. Apparatus according to claim 6, further characterized by (a) said first control means comprising memory means for effecting incrementation of a data count for each signal of incremental movement, (b) said second control means comprising means for effecting decrementation of said data count at the rate of two counts for each signal of incremental movement, and (c) said means for engaging and restraining becomes effective upon said data count being decremented to zero.

10. Apparatus according to claim 9, further characterized by (a) independently adjustable control means being provided for controllably incrementing and decrementing said data count to provide for fine adjustment of the final delivery positions of said individual plies.

11. Apparatus according to claim 6, further characterized by (a) said means for engaging and restraining said fabric plies comprising solenoid actuated elements adapted, upon actuation, to engage and restrain the trailing end portions of said plies, individually, while enabling continued movement of said shutter.

12. The method of transferring and centering fabric workpieces for aligned assembly, which comprises (a) loading a workpiece of unknown length on a transfer element, (b) advancing the transfer element along a path to convey said fabric workpiece toward a position beyond a predetermined, aligned delivery position, (c) digitizing the movement of said transfer element and providing an output signal corresponding to each increment of transfer movement of said transfer element, (d) sensing the passage of the leading edge of said workpiece during movement of said workpiece toward said delivery position and thereupon commencing to increment a data count reflecting the number of increments of transfer movement, (e) sensing the passage of the trailing edge of said workpiece during said movement and thereupon terminating the incrementation of said data count, (f) sensing at a second location the passage of said leading edge during said movement and thereupon commencing a data count reflecting the approach of the center of said workpiece toward said delivery position, (g) effectively continually comparing said first and second data counts, and (h) engaging and restraining said ply against further transfer movement, independently of continued movement of said transfer element, when said compared data counts indicate that the center of said workpiece is aligned with said predetermined delivery position.

13. The method of claim 12, further characterized by (a) said second data count being commenced only after said workpiece has travelled at least one-half of its length after commencement of said first data count.

14. The method of claim 13, further characterized by (a) said second data count being conducted by decrementation of said first data count, (b) said decrementation being carried out at twice the rate, per unit of transfer element movement, as the incrementation of said first data count, whereby said data count approaches zero as the center of said workpiece approaches precise alignment with said delivery position.

15. The method of claim 12, further characterized by (a) there being a plurality of fabric workpieces arranged in side-by-side relation, (b) each of said workpieces being individually transferred to align its center line, between its leading and trailing ends, along a common delivery axis.

16. The method of claim 15, further characterized by (a) providing a common transfer element, (b) effecting transfer movement of said plurality of workpieces by depositing said workpieces on said common transfer element and advancing said transfer element toward said delivery position.

17. The method of claim 16, further characterized by (a) individually engaging and restraining said workpieces during continued movement of said transfer element.

* * * * *